US005411261A

United States Patent [19]

Jacques

[11] Patent Number: 5,411,261

[45] Date of Patent: May 2, 1995

[54] PUZZLE BOX

[76] Inventor: Carol Jacques, 35 Federal St., Walpole, Mass. 02081

[21] Appl. No.: 260,540

[22] Filed: Jun. 16, 1994

[51] Int. Cl.[6] ..... A63F 9/12; E05B 37/20

[52] U.S. Cl. ..... 273/156; 70/289; 206/1.5

[58] Field of Search ..... 273/156, 153 S, 153 R; 70/77, 78, 79, 289; 206/1.5

[56] References Cited

U.S. PATENT DOCUMENTS

| | | | |
|---|---|---|---|
| 399,050 | 3/1889 | Kimball | 70/289 |
| 849,587 | 4/1907 | Warwick | 70/289 |
| 855,268 | 5/1907 | Watson et al. | 70/289 |
| 1,017,343 | 2/1912 | Szumlinski | 206/1.5 |
| 1,090,139 | 3/1914 | Edmonds | 273/156 |
| 1,181,632 | 5/1916 | Bendig | 206/1.5 |
| 1,733,772 | 10/1929 | Battershell | 273/156 |
| 1,944,722 | 1/1934 | Soderberg | 206/1.5 |
| 2,449,722 | 9/1948 | Saathoff | 70/289 |
| 3,216,558 | 11/1965 | Marsh | 273/153 S |
| 3,821,886 | 7/1974 | Ladewig | 70/366 |
| 4,336,699 | 6/1982 | Green | 70/290 |
| 4,397,466 | 8/1983 | Nichols | 273/156 |
| 4,546,979 | 10/1985 | Knott | 273/153 S |
| 4,687,202 | 8/1987 | Palma | 273/157 R |
| 4,692,119 | 9/1987 | Ussery | 434/259 |
| 4,838,058 | 6/1989 | Matsumoto | 70/355 |
| 5,125,661 | 6/1992 | Jarboe | 273/156 |

*Primary Examiner*—Vincent Millin
*Assistant Examiner*—Steven B. Wong
*Attorney, Agent, or Firm*—Weingarten, Schurgin, Gagnebin & Hayes

[57] ABSTRACT

A puzzle box includes a compound rotatable lid having at least one locking pin transferable between cooperating grooves formed in the compound lid. Gravity is relied upon to induce pin transfer after precise alignment of cover plates which make up the compound lid. A slot in a first cover plate enables retraction of a locking member from a receptacle in a box wall and subsequent first cover plate rotation after pin transfer and rotation of a second cover plate.

8 Claims, 5 Drawing Sheets

PUZZLE BOX

FIELD OF THE INVENTION

The present invention relates to puzzle boxes having a locking mechanism, and in particular to a puzzle box having a lid secured by a locking mechanism employing a pin transferable between coordinated slots by gravity.

BACKGROUND OF THE INVENTION

Puzzles boxes are known to provide entertainment and an educational challenge to those unfamiliar with the structure of a particular locking mechanism or with a sequence of steps required to unlock the box. Such puzzles include boxes having side walls comprised of sliding blocks which must be precisely arranged to unlock the box. Others rely solely on gravity to sequentially orient a number of locking elements such as pins and pin obstructions such as balls or small dowels. Such sequential orientation is provided by three-dimensional rotation of locked objects including boxes. Additional mechanisms require the insertion or withdrawal of multiple threaded fasteners. Another prior art concept requires the assembly of box wall panels by knotting string or thread attached to each panel.

None of these prior art puzzles require both sequential orientation of a structure in three-dimensional space and manipulation of transferable elements associated with the puzzle for disengagement of a locking mechanism.

SUMMARY OF THE INVENTION

The present invention employs a compound rotatable lid having at least one locking pin transferable between cooperating grooves of at least one pair of such grooves formed in the compound lid. While the force of gravity is relied upon to induce pin transfer, the present invention also relies upon the precise alignment of cover plates, which make up the compound lid, and the grooves disposed therein to enable pin transfer. A slot in a first cover plate enables retraction of a locking member from a receptacle in a box wall and subsequent first cover plate rotation after pin transfer and rotation of a second cover plate. Therefore, mere fortuitous three-dimensional orientation of the puzzle box according to the present invention will not provide access to the interior of the puzzle box, incident to representative examples of the prior art.

BRIEF DESCRIPTION OF THE DRAWINGS

These and other features of the present invention are more fully set forth below in the fully exemplary detailed description and accompanying drawings of which.

DETAILED DESCRIPTION

Figure 1:
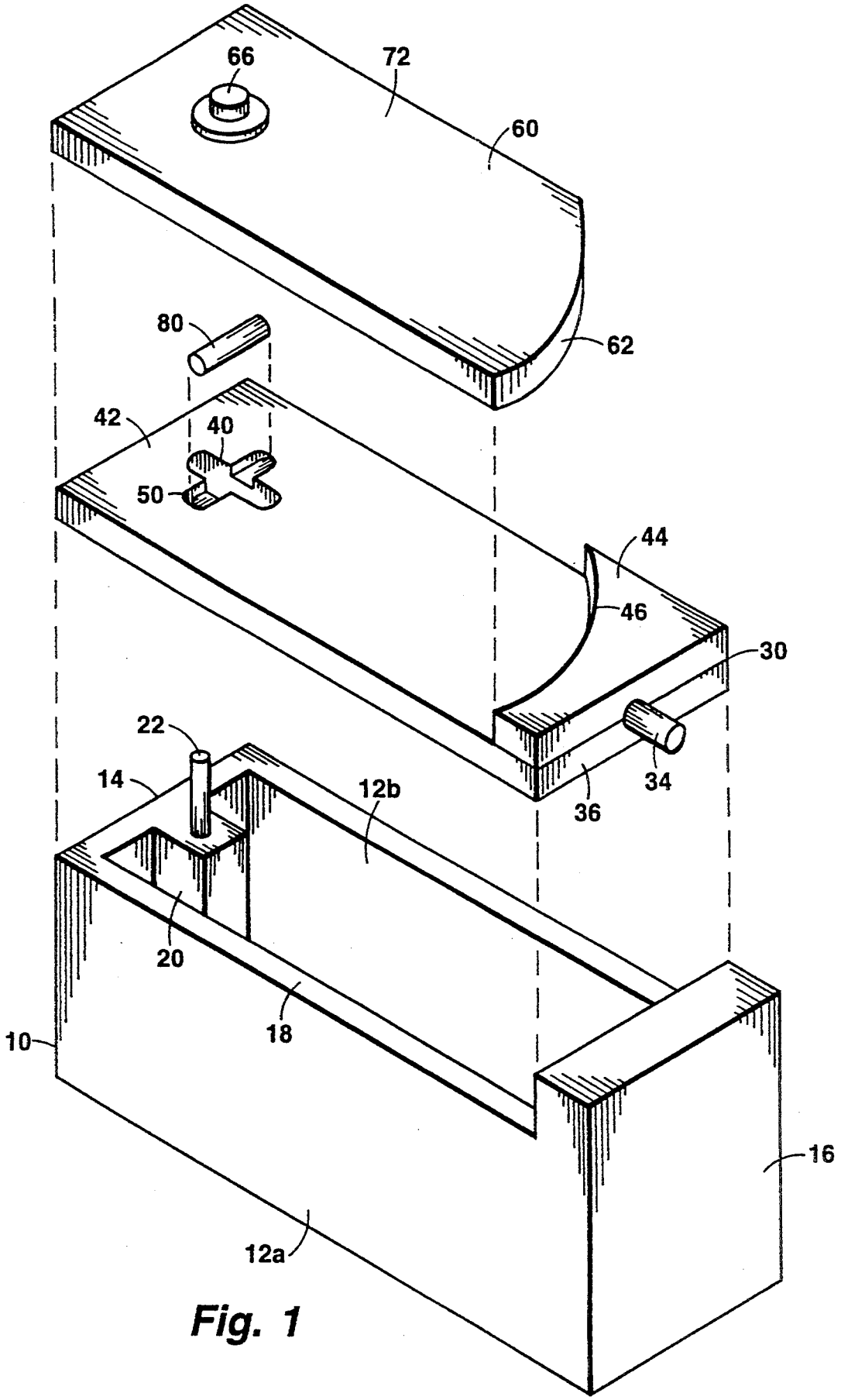
FIG. 1 is an exploded right-hand perspective view of the puzzle box according to the present invention.
Figure 2:
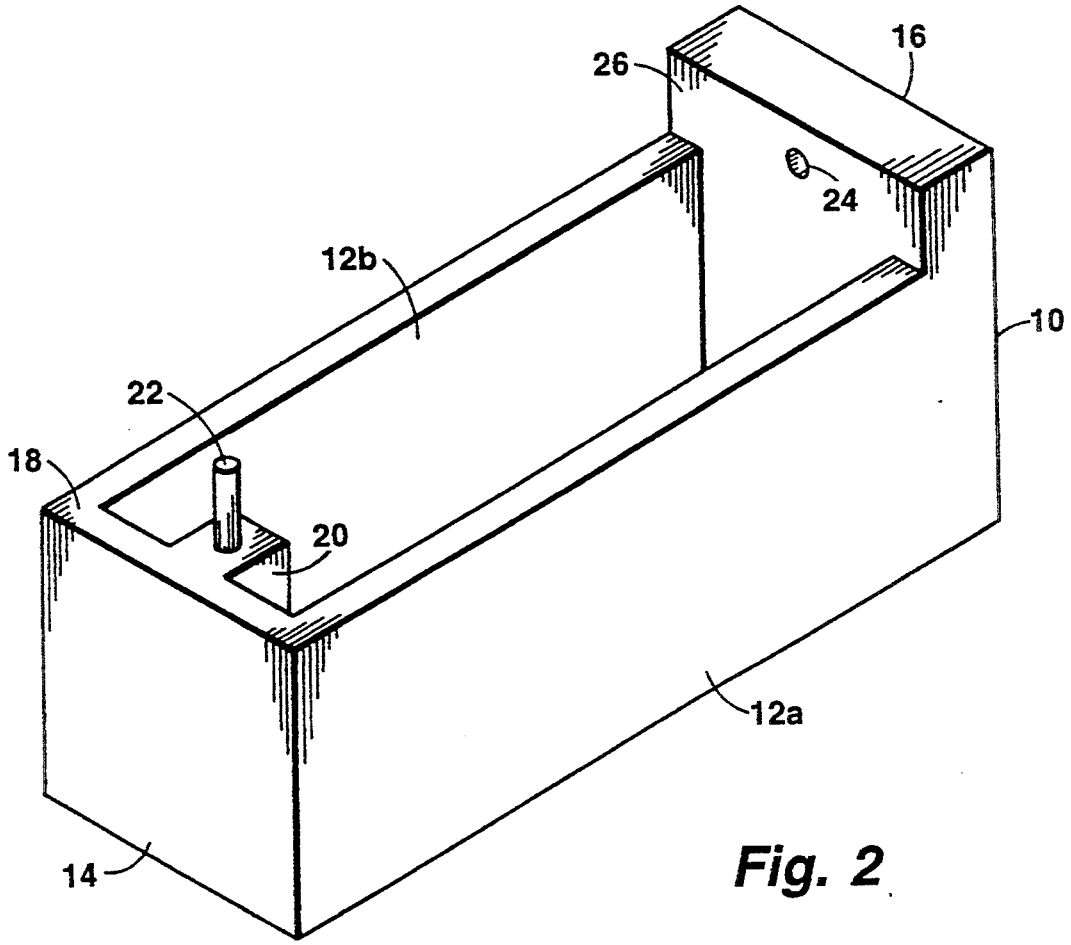
FIG. 2 is a left-hand perspective view of a box according to the invention of FIG. 1.

An illustrative embodiment of the present invention, as shown in FIG. 1, includes a puzzle box 10 having four side walls including two side walls 12*a*, 12*b*, an end wall 14, and a lock wall 16. As shown in FIGS. 1 and 2, the lock wall 16 is higher than each of the side walls 12*a*, 12*b* and the end wall 14. Further, the side walls 12*a*, 12*b* and the end wall 14 are the same height, providing a continuous upper edge 18 across those three walls. The present embodiment further includes a planar bottom surface, not shown, thus forming a continuous, five-sided enclosure 10.

Extending from an anchor position 20 within the box 10 is a vertically aligned shaft 22. The anchor position 20 does not extend beyond the side wall and end wall upper edge 18, though the shaft 22 does, extending in the present embodiment to the height of the lock wall 16.

Figure 3A:
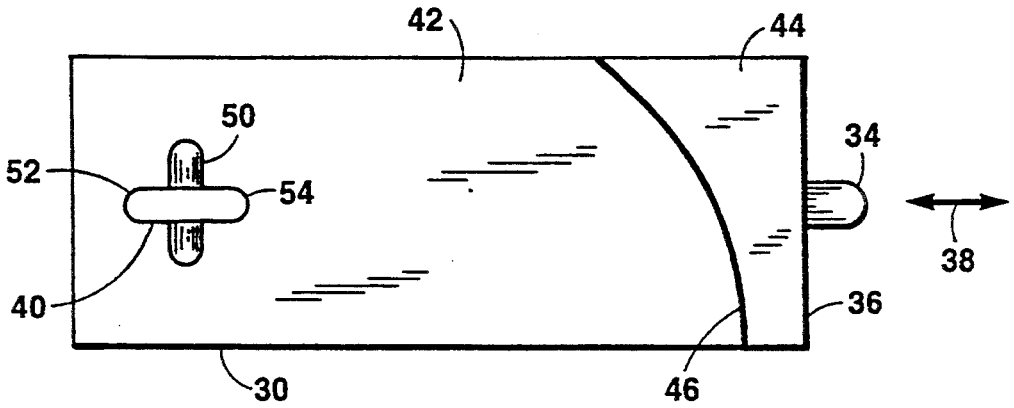
FIG. 3A is a top view of a first cover plate according to the invention of FIG. 1.
Figure 3B:
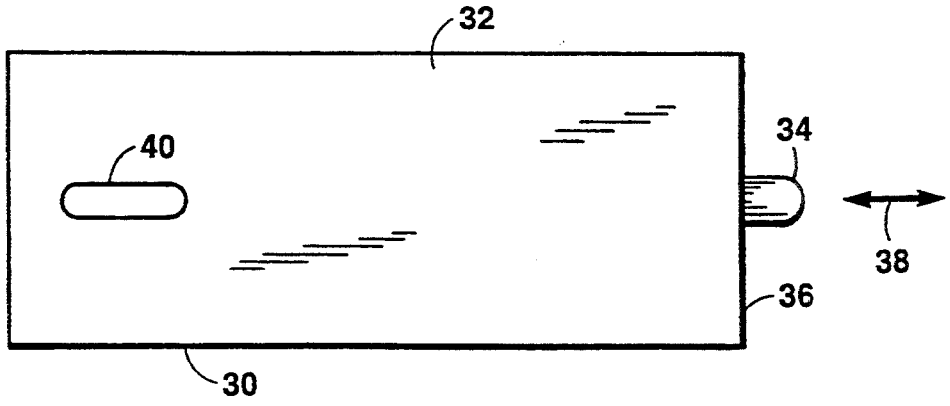
FIG. 3B is a bottom view of the first cover plate of FIG. 3A.

Disposed upon the upper edge 18 of the side walls 12*a*, 12*b* and the end wall 14 of the box is a first cover plate 30, as shown in FIGS. 1, 3A and 3B. This first cover plate 30 has a planar bottom surface 32, dimensioned to rest on the upper edge 18 and to cover the enclosure defined by the side walls 12*a*, 12*b*, the end wall 14, and the lock wall 16. A locking member 34 protrudes off a first end 36 of the first cover plate 30, defining a first axis 38. This locking member 34 is dimensioned to fit cooperatively into a bore 24 disposed on the inside face 26 of the lock wall 16, as shown in FIG. 2.

The first cover plate 30 also has a slot 40 generally coaxial with the first axis 38 defined by the locking member 34. This slot 40 is cut completely through the first cover plate 30. Orthogonal to the slot 40 and disposed approximately midway along the length of the slot 40 is a first groove 50 having approximately the same length and width dimensions of the slot 40 within the plane of the first cover plate 30. The first groove 50 thus divides the slot 40 into a first slot end 52 and a second slot end 54 on opposite sides of the groove 50.

The first cover plate 30, in the illustrated embodiment, is comprised of a first portion 42 having the bottom surface 32 and a second portion 44. The first portion 42, in the embodiment of FIG. 3B, is one continuous rectangular sheet of material having the slot 40 cut therethrough. The second portion 44 is a block of material having three linear sides, corresponding to the first end 36 of the first cover plate 30 and each of the side walls 12*a*, 12*b*, and an arcuate side 46. As noted, the locking member 34 protrudes from the first end 36 of the cover plate 30 which is comprised of the first portion 42 and the second portion 44.

The first cover plate 30 is placed on the upper edge 18 of the box 10 such that the shaft 22 passes through the slot 40. In a locked position, the first cover plate 30 is urged toward the lock wall 16 such that the locking member 34 extends into the wall bore 24. The shaft 22 will be in the first slot end 52 when the first cover plate 30 is in the locked position. In an unlocked position, the first cover plate 30 is urged away from the lock wall 16 along the first axis 38 such that the locking member 34 is external to the wall bore 24 and the shaft 22 is in the second slot end 54.

Figure 4A:
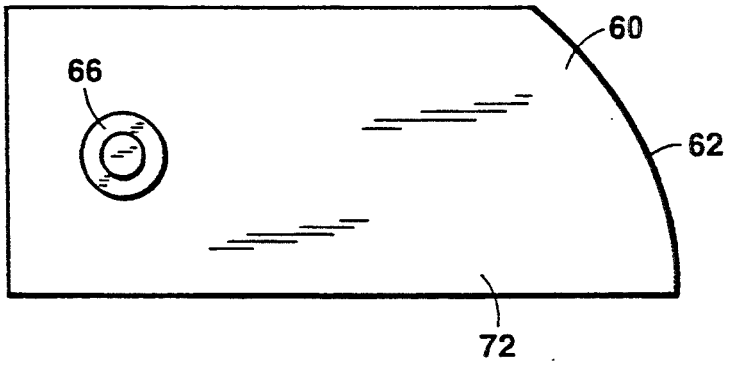
FIG. 4A is a top view of a second cover plate according to the invention of FIG. 1.

A second cover plate 60 is disposed proximate the first cover plate 30, and in the plan view of FIG. 4A, has three linear sides, corresponding to the side walls 12*a*, 12*b* and the end wall 14, and an arcuate side 62 corresponding to the arcuate side 46 of the first cover plate 30. A bottom surface 70 of the second cover plate 60 is disposed on the exposed surface of the first portion 42 of the first cover plate 30 with the shaft 22 extending upward into a cooperating socket 68 disposed in the second cover plate bottom surface 70. In the illustrative embodiment of FIG. 4A, a knob 66 located on an upper surface 72 of the second cover plate 60 facilitates rotation of the second cover plate 60 about the shaft 22.

Figure 4B:
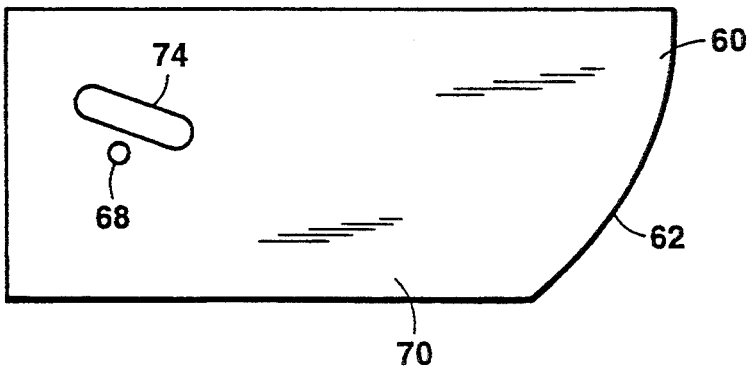
FIG. 4B is a bottom view of the second cover plate of FIG. 4A.

As illustrated in FIG. 4B, a second groove 74 is formed on the bottom surface 70 of the second cover plate 60, proximate the shaft socket 68. Note that the second groove 74, as illustrated, is rotated around the shaft socket 68 with respect to the location of the first groove found on the first cover plate 30. Thus, when the second cover plate 60 is disposed on the first cover plate 30 and the sides of each are aligned, the first and second grooves 50, 74 are out of register. It is only when the first cover plate 30 is in the locked position such that the shaft 22 passes through the first slot end 52 and the second cover plate 70 is rotated about the shaft 22 that the first and second grooves 50, 74 are aligned.

In the locked position, the puzzle box according to the present invention is assembled as shown in an exploded view in FIG. 1. The first cover plate 30 is disposed atop the box 10 such that the shaft 22 passes through the first end of the slot 52 and the locking member 34 is inserted into the wall bore 24. A pin 80 is located with the first groove 50, preventing the first cover plate 30 from sliding away from the locking wall 16 along the first axis 38. The second cover plate 60 is then installed on the shaft 22 and aligned with respect to the first axis 38. The pin 80 is thus restricted to the first groove 50, and the shaft 22 is prevented from sliding in the slot 40.

Figure 5A:
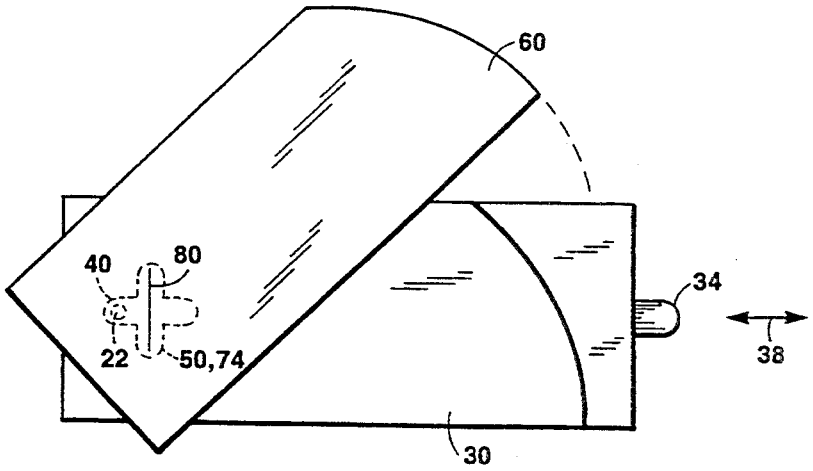
FIG. 5A is a top view of the second cover plate of FIG. 4A disposed upon the first cover plate of FIG. 3A with elements of each shown in phantom.

In order to unlock the puzzle box 10, it is necessary to align the first and second grooves 50, 74. This is done by rotating the second cover plate 60 until the second groove 74 overlies the first groove 50, as illustrated in FIG. 5A. The box 10 is inverted such that the second cover plate 60 is now facing downward. This causes the pin 80 to fall from the first groove 50 into the second groove 74. However, the pin 80 remains in the way of the shaft 22, thus preventing the unlocking of the box 10.

Figure 5B:
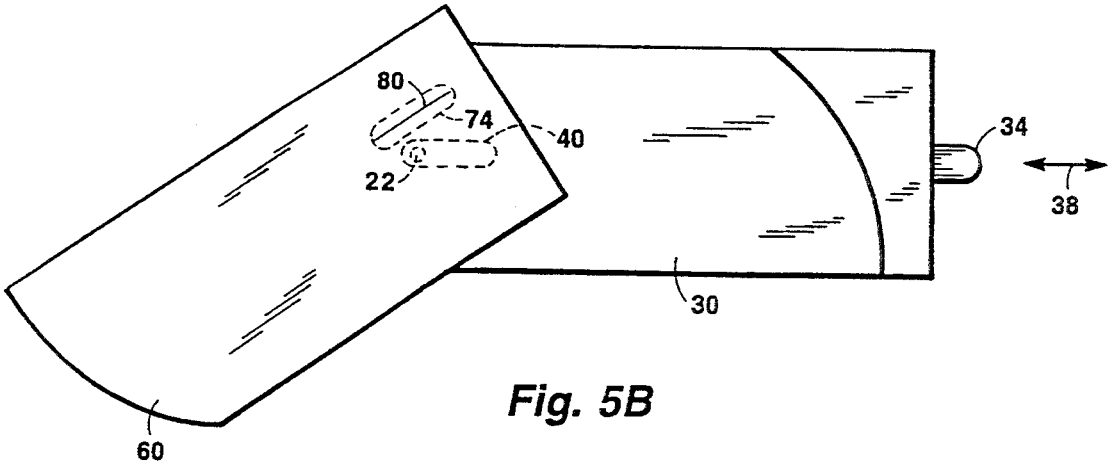
FIG. 5B is a top view of FIG. 5A in which the cover plates have been rotated.

By rotating the second cover plate 60 with respect to the first cover plate 30 and the box 10, the pin 80 is now carried out of the path of the shaft 22 within the slot 40. Once the second cover plate 60 is rotated to a position such as that illustrated in FIG. 5B, the first cover plate 30 is able to slide away from the locking wall 16 with shaft 22 moving from the slot first end 52 to the slot second end 54. The locking member 34 is thus removed from the wall bore 24, enabling rotating of the second cover plate about the shaft 22. However, if any items are stored within the box 10, it is preferable to employ an intermediate step of once again inverting the box 10 prior to unlocking the first cover plate 30.

Locking of the box 10 involves alignment of the locking member 34 with the first axis 38 and sliding the first cover plate 30 toward the locking wall 16, inserting the locking member 34 into the wall bore 24. This alone will not lock the box 10 since the shaft 22 is still free to slide along the length of the slot 40. With the first cover plate 30 in the locked position and the shaft 22 in the slot first end 52, the second cover plate must be rotated such that the first and second grooves 50, 74 are in register, allowing the pin 80 to fall from the second groove 74 into the first groove 50. The box 10 is then locked. For appearance sake, the second cover plate 60 can then be rotated into alignment with the first cover plate 30, though this has no effect on the locked state of the box 10.

The box 10 of the present invention has been described as a rectangular enclosure. It is noted that in alternative embodiments, the enclosure is any shape, including semispherical as long a raised region analogous to the locking wall 16 is provided, having a wall bore 24 disposed therein.

The anchor position 20 has been described and illustrated as an extension of the end wall 14, protruding into the interior of the box 10. Alternative configurations for this anchor 20 include a socket disposed in the bottom surface of the box 10, and/or a brace member extending from the end wall 14 proximate the upper edge 18 having the shaft 22 extending therethrough.

Further, the first cover plate 30 can have a wall bore 24 formed therein if the locking wall 16 has a cooperating locking member 34 protruding therefrom. The first cover plate 30 can also be formed as a one piece block, rather than having two discrete portions 42, 44 as described. Additionally, the arcuate edge 46 of the described embodiment can have alternative shapes, including a progressive curve, multiple curves, or a linear edge.

Further embodiments of the present invention include more than two cover plates. In one further embodiment, a number N of cover plates are employed, along with N−1 locking pins. A topmost cover plate having a first groove disposed in a bottom surface is free to rotate as in the above-described embodiment. Each of the remaining cover plates has a locking member 34 protruding into a cooperating wall bore 24. In a locked position, adjacent cover plates form cover plate pairs, each having pairs of alignable slots and one pin transferable therebetween as in the above-described embodiment. By transferring a pin to the topmost cover plate from a cover plate immediately thereunder, the latter is free to act as the top plate in the next pair of plates. By successively transferring pins to upper plates and relocating the pins out of the way of the common shaft, the box is unlocked.

Lastly, in an illustrative embodiment, the box 10, excluding the locking wall 16, is formed of a clear material such as plexiglass or LUCITE, thus enabling the viewing of box 10 contents. Such contents can include items attractive to children, such as candy or small toys, or items targeted to adults, such as advertising or promotional materials. This provides excitement and an incentive for individuals to solve the puzzle. However, the remaining elements such as the locking wall 16 and the cover plates are made from opaque materials to avoid allowing the individual to solve the puzzle by viewing the alignment of the grooves 50, 74, the shaft 22, the slot 40, and the locking member 34 within the wall bore 24. In alternative embodiments, the box 10 and associated parts are made of metal, wood, or other suitable materials.

These and other examples of the concept of the invention illustrated above are intended by way of example and the actual scope of the invention is to be determined from the following claims.

What is claimed is:

1. A locking enclosure comprising:

an enclosure having an opening, defined by a side wall having an upper edge lying in a plane, and a raised portion extending above said side wall upper edge;

a shaft fastened within said enclosure, said shaft vertically aligned and extending above said upper edge of said enclosure;

a first cover plate having a top surface, said first cover plate disposed in a closed position proximate said raised portion, said first cover plate including:

a slot disposed through said first cover plate and having first and second slot ends with said shaft extending through said first end with said first cover plate in said closed position;

a first groove disposed in said first cover plate top surface, said first groove extending across said slot between said first and second slot ends; and a horizontally extending locking member selectively engaging said raised portion with motion of said cover plate in a direction determined by said slot and shaft;

a second cover plate having a bottom surface, said second cover plate bottom surface in a closed position disposed proximate said first cover plate top surface and pivotably secured to said shaft, said second cover plate including:

a second groove, disposed in said second cover plate bottom surface and adjacent said shaft, wherein said second groove is aligned with said first groove by rotation of said second cover plate about said shaft; and a pin dimensioned to fit entirely within each said first and second grooves and imparting to said first and second cover plates a first, locked position with said pin lying within said first groove, and a second, unlocked position with said pin lying within said second groove, said pin transferrable under gravity between cover plates by rotation of said second cover plate to produce alignment of said first and second grooves and appropriate orientation of said enclosure.

2. The locking enclosure according to claim 1, wherein said side wall has at least one planar component.

3. The locking enclosure according to claim 1, wherein said enclosure has a planar bottom component.

4. The locking enclosure according to claim 1, wherein said enclosure is rectangular in shape.

5. The locking enclosure according to claim 1, wherein a portion of said enclosure is translucent.

6. The locking enclosure according to claim 1, wherein said second cover plate further includes a knob rigidly attached to a top surface of said second cover plate, said knob substantially coaxial with an axis defined by said shaft.

7. A method for manipulating a locked puzzle having an enclosure covered by compound cover plates, said method comprising:

orienting said enclosure to a starting position with said cover plates facing vertically upward;

rotating an uppermost, second cover plate with respect to an underlying, first cover plate about a common shaft to align a pair of grooves, said pair comprising a first groove disposed in an upper surface of said first cover plate and a second groove disposed in a bottom surface of said second cover plate, said first groove disposed across a slot in said first cover plate through which said shaft extends;

transferring a pin from said first cover plate groove to said second cover plate groove by inverting said enclosure;

rotating said second cover plate about said shaft with respect to said first cover plate such that said grooves are at least ninety degrees out of mutual alignment about said shaft;

inverting said enclosure to orient said cover plates facing vertically upward;

sliding said first cover plate and an associated locking element away from an enclosure wall by transferring said shaft along a slot disposed in said first cover plate, said first groove disposed across said slot; and rotating said first cover plate to provide access to said interior region of said box.

8. A method for manipulating an unlocked puzzle having an enclosure covered by compound cover plates, said method comprising:

orienting said enclosure to a starting position with said cover plates facing vertically upward;

rotating a lowermost, first cover plate with respect to said enclosure about a common shaft to align said first cover plate with said enclosure, said shaft passing through a slot disposed through said first cover plate;

sliding said first cover plate and an associated locking element towards an enclosure wall by transferring said shaft along said slot;

rotating an overlying, second cover plate with respect to said lowermost, first cover plate about said common shaft for:

aligning a pair of grooves, said pair comprising a first groove disposed in an upper surface of said first cover plate and a second groove disposed in a bottom surface of said second cover plate, said second groove having a pin disposed therein, said first groove disposed across said slot, and transferring said pin from said second cover plate groove to said first cover plate groove by force of gravity; and rotating said second cover plate about said shaft with respect to said first cover plate such that said grooves are out of mutual alignment and said second cover plate is aligned with respect to said enclosure.

* * * * *